US010914503B2

(12) United States Patent
Walser

(10) Patent No.: US 10,914,503 B2
(45) Date of Patent: Feb. 9, 2021

(54) COIL HEATING SYSTEMS FOR HEAT PUMP SYSTEMS

(71) Applicant: Johnson Controls Technology Company, Auburn Hills, MI (US)

(72) Inventor: Jay C. Walser, Norman, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 141 days.

(21) Appl. No.: 15/927,475

(22) Filed: Mar. 21, 2018

(65) Prior Publication Data

US 2019/0234676 A1 Aug. 1, 2019

Related U.S. Application Data

(60) Provisional application No. 62/625,169, filed on Feb. 1, 2018.

(51) Int. Cl.
*F25D 21/00* (2006.01)
*F25D 21/08* (2006.01)

(52) U.S. Cl.
CPC ..... *F25D 21/006* (2013.01); *F25D 21/08* (2013.01); *F25B 2313/0315* (2013.01); *F25B 2347/023* (2013.01); *F25D 2700/10* (2013.01)

(58) Field of Classification Search
CPC ..... F25B 2313/0315; F25B 2347/023; F25D 21/006; F25D 21/08; F25D 2700/10
See application file for complete search history.

(56) References Cited

U.S. PATENT DOCUMENTS 4,117,698 A * 10/1978 Vogel ..... A47F 3/0447 312/116
RE29,966 E 4/1979 Nussbaum
4,400,949 A * 8/1983 Kinoshita ..... F25D 21/02 62/140
5,715,690 A 2/1998 Ponder
5,722,245 A 3/1998 Ponder
5,727,395 A * 3/1998 Guo ..... F25D 21/006 62/155
6,609,388 B1 * 8/2003 Hanson ..... B60H 1/321 62/151
2005/0230378 A1 * 10/2005 Abbott ..... C23C 4/123 219/543
2010/0170282 A1 * 7/2010 Kim ..... F24F 11/30 62/276
2010/0218528 A1 * 9/2010 Yakumaru ..... F25B 47/022 62/234
2010/0251742 A1 * 10/2010 Tucker ..... F24F 1/0059 62/324.6
2013/0081415 A1 * 4/2013 Kim ..... F25D 21/02 62/129

(Continued)

FOREIGN PATENT DOCUMENTS

EP 2381740 10/2011
WO 2008091110 7/2008

*Primary Examiner* — Henry T Crenshaw
(74) *Attorney, Agent, or Firm* — Fletcher Yoder, P.C.

(57) ABSTRACT

A heat pump system includes a heat exchanger coil and a heater configured to transfer heat to the heat exchanger coil. The heat pump system also includes a controller communicatively coupled to the heater. The controller is configured to activate the heater in response to determining that a detected temperature of the heat exchanger coil is below a threshold temperature for a threshold time period.

26 Claims, 7 Drawing Sheets

(56) References Cited

U.S. PATENT DOCUMENTS

| | | | | |
|---|---|---|---|---|
| 2014/0216078 | A1 | 8/2014 | Ladd | |
| 2015/0027144 | A1* | 1/2015 | Lee | F24F 11/30 62/80 |
| 2015/0184927 | A1* | 7/2015 | Fowler | F28D 1/0477 62/276 |
| 2015/0338145 | A1* | 11/2015 | Kim | F25B 7/00 62/228.1 |
| 2016/0209093 | A1* | 7/2016 | Sulc | F25B 49/02 |
| 2017/0176072 | A1* | 6/2017 | Gokhale | F25B 49/00 |
| 2017/0176084 | A1* | 6/2017 | Iwamoto | F25D 21/002 |
| 2017/0336114 | A1* | 11/2017 | Lee | F25B 47/022 |
| 2017/0363332 | A1* | 12/2017 | Yanachi | F24F 11/86 |
| 2018/0292121 | A1* | 10/2018 | Kim | F25B 39/024 |
| 2018/0335236 | A1* | 11/2018 | Kasai | F24F 11/89 |
| 2019/0003760 | A1* | 1/2019 | Goodjohn | F25D 21/125 |
| 2019/0226737 | A1* | 7/2019 | He | F25B 40/00 |

* cited by examiner

COIL HEATING SYSTEMS FOR HEAT PUMP SYSTEMS

CROSS-REFERENCE TO RELATED APPLICATION

This application is a Non-Provisional Application claiming priority to U.S. Provisional Application No. 62/625,169, entitled "COIL HEATING SYSTEMS FOR HEAT PUMP SYSTEMS," filed Feb. 1, 2018, which is hereby incorporated by reference in its entirety for all purposes.

BACKGROUND

The present disclosure relates generally to heating, ventilating, and air conditioning (HVAC) systems, and more particularly, to coil heating systems for outdoor heat exchangers of heat pump systems.

Residential, light commercial, commercial, and industrial systems are used to control temperatures and air quality in buildings. To condition a building, a HVAC system may circulate a refrigerant through a closed circuit between an evaporator where the refrigerant absorbs heat and a condenser where the refrigerant releases heat. The refrigerant flowing within the closed circuit is generally formulated to undergo phase changes within the normal operating temperatures and pressures of the HVAC system so that quantities of heat can be exchanged by virtue of the latent heat of vaporization of the refrigerant to provide conditioned air to the buildings.

In certain instances, the HVAC system may operate in several modes, including a heat pump mode. Additionally, the HVAC system may include an indoor unit, an outdoor unit, or both. When operating in the heat pump mode, a heat exchanger of the outdoor unit may operate as the evaporator, providing heat to the refrigerant from an exterior environment. Under certain conditions, such as high humidity and temperatures around or below a freezing point of water, water may condense and/or freeze as frost on the heat exchanger of the outdoor unit, thus reducing an efficiency of the HVAC system. To remove or mitigate frost formation on the heat exchanger, the HVAC system may reverse a flow of the refrigerant within the closed circuit, thus warming the heat exchanger of the outdoor unit, which now operates as the condenser. However, such operation may demand a large amount of energy and/or provide cooled air to the building during the heat pump mode of the HVAC system. Accordingly, improved defrost operations for HVAC systems are desired.

SUMMARY

In one embodiment of the present disclosure, a heat pump system includes a heat exchanger coil and a heater configured to transfer heat to the heat exchanger coil. The heat pump system also includes a controller communicatively coupled to the heater. The controller is configured to activate the heater in response to determining that a detected temperature of the heat exchanger coil is below a threshold temperature for a threshold time period.

In another embodiment of the present disclosure, a heat pump system includes a heat exchanger having a coil configured to circulate a refrigerant in a common direction in both a heating mode and a defrost mode of the heat pump system. The heat pump system also includes a heater configured to transfer heat to the coil when activated and having a resistive coating disposed on the coil.

In a further embodiment of the present disclosure, a heat pump system includes a heat exchanger coil. The heat pump system also includes a resistive heater configured to transfer heat to the heat exchanger coil when activated and including a resistive coating disposed on the heat exchanger coil. Additionally, the heat pump system includes a controller communicatively coupled to the resistive heater. The controller is configured to activate the resistive heater in a defrost mode in response to determining that a parameter of the heat pump system is outside of a threshold parameter for a threshold time period.

Other features and advantages of the present application will be apparent from the following, more detailed description of the embodiments, taken in conjunction with the accompanying drawings which illustrate, by way of example, the principles of the application.

DETAILED DESCRIPTION

Figure 1:
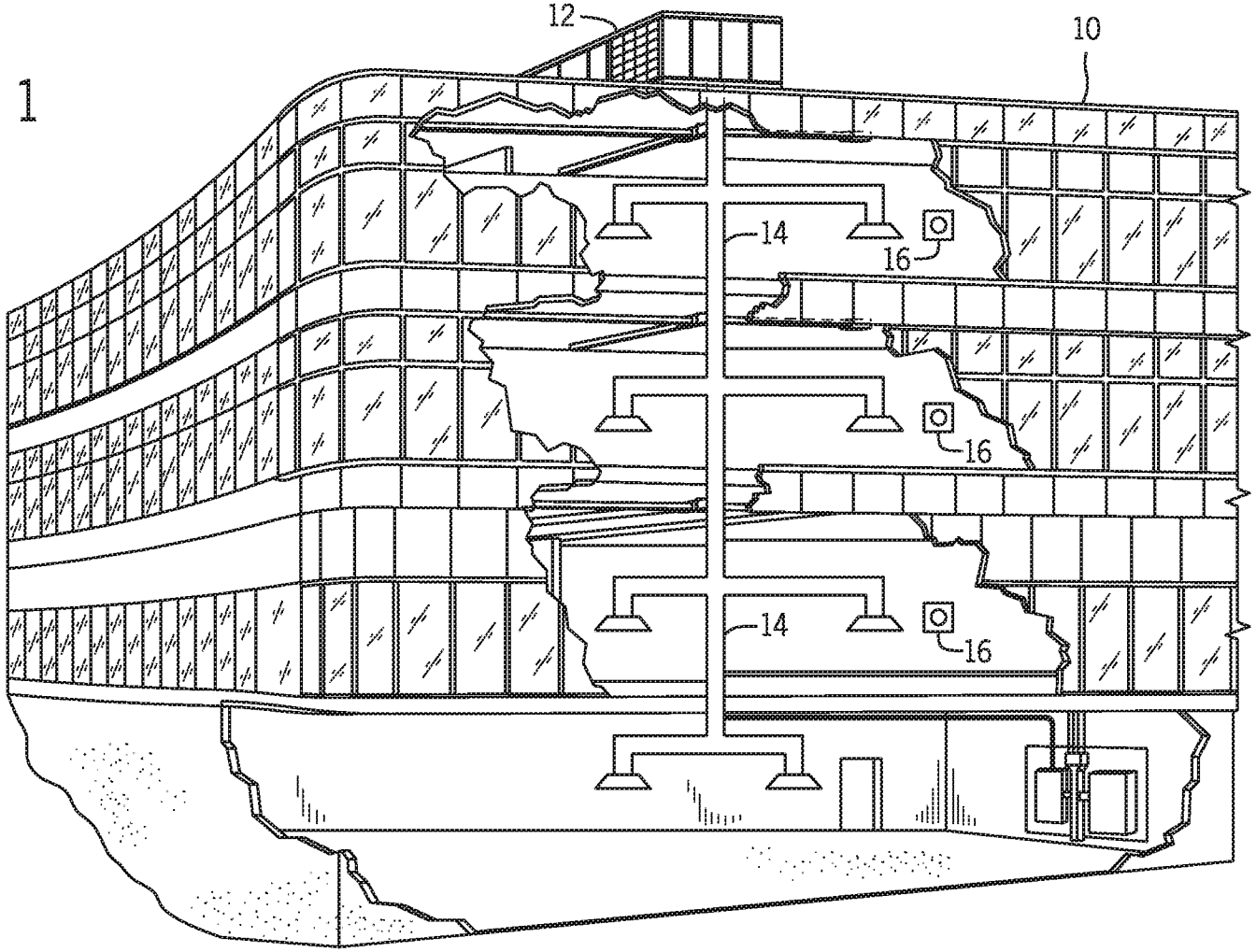
FIG. 1 is an illustration of an embodiment of a commercial or industrial HVAC system, in accordance with present techniques.

The present disclosure is directed to a coil heating system for mitigating frost or other frozen liquid formation for heat pump systems. As used herein, a heat pump system is intended to refer to any suitable split-type or packaged HVAC system that is capable of operating as a heat pump. The heat pump system may provide warm air to an interior space of a building during a heating mode, and may provide cooled air to the interior space of the building when operating in a cooling mode. As mentioned above, water or other liquid may condense and/or freeze to form frost on a heat exchanger of an outdoor unit of the heat pump system under certain conditions, such as when the heat pump system is operating in the heating mode in which the outdoor unit operates as an evaporator. The frost or other frozen liquid may reduce a surface area of the heat exchanger that is available for heat transfer with the refrigerant flowing within coils of the heat exchanger, thus reducing an efficiency of the heat pump system. Additionally, traditional defrosting systems may reverse a refrigerant flow direction within the coils to heat the coils and remove the frost. However, operation of the traditional defrosting systems may undesirably cause the heat pump system to provide cool air to the interior space of the building, even when warm air is requested. Moreover, reversing the refrigerant flow direction may cause a pressure drop in the refrigerant that impacts operating efficiency of the heat pump system.

With the foregoing in mind, present embodiments are directed to a coil heating system that removes or mitigates frost formation on the coils of the heat exchanger via a resistive heating assembly, or resistive heater, disposed on the coils. For example, the resistive heating assembly may include a thermal resistive coating applied to the coils, a thermal resistive element coupled to the coils, or a combination thereof. Based on a detected temperature of the coils and/or a detected power usage of a fan drawing air over the heat exchanger, a controller or control panel of the coil heating system may instruct the resistive heating assembly to activate and provide thermal energy or heat to the coils. As such, the coils may warm to a temperature above the freezing point of water. By selectively providing thermal energy to the coils of the heat exchanger, the coil heating system may reduce a demand for reversing the refrigerant flow direction within the closed circuit, thus providing warm air to the interior space of the building and/or improving an efficiency of the heat pump system. Additionally, in some embodiments, the coil heating system may be activated during the heating mode of the heat pump system in response to a request for supplemental heating of the interior space of the building, such that the coil heating system provides additional thermal energy directly to the refrigerant that enables the heat pump system to provide warm air at a higher temperature and/or more rapidly to the interior space of the building. These and other features will be described in detail below with reference to the drawings.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes a HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
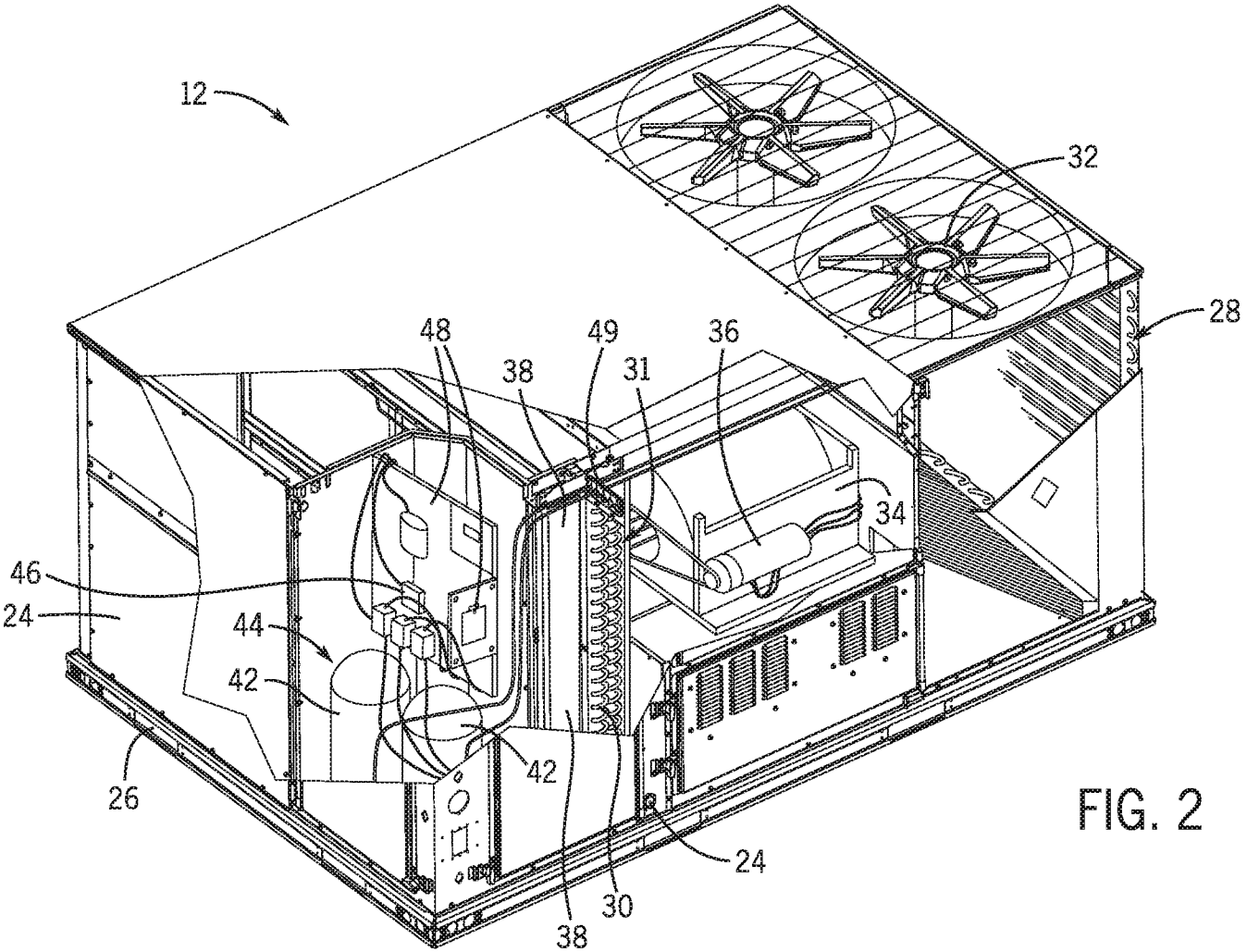
FIG. 2 is an illustration of an embodiment of a packaged unit of the HVAC system, in accordance with present techniques.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
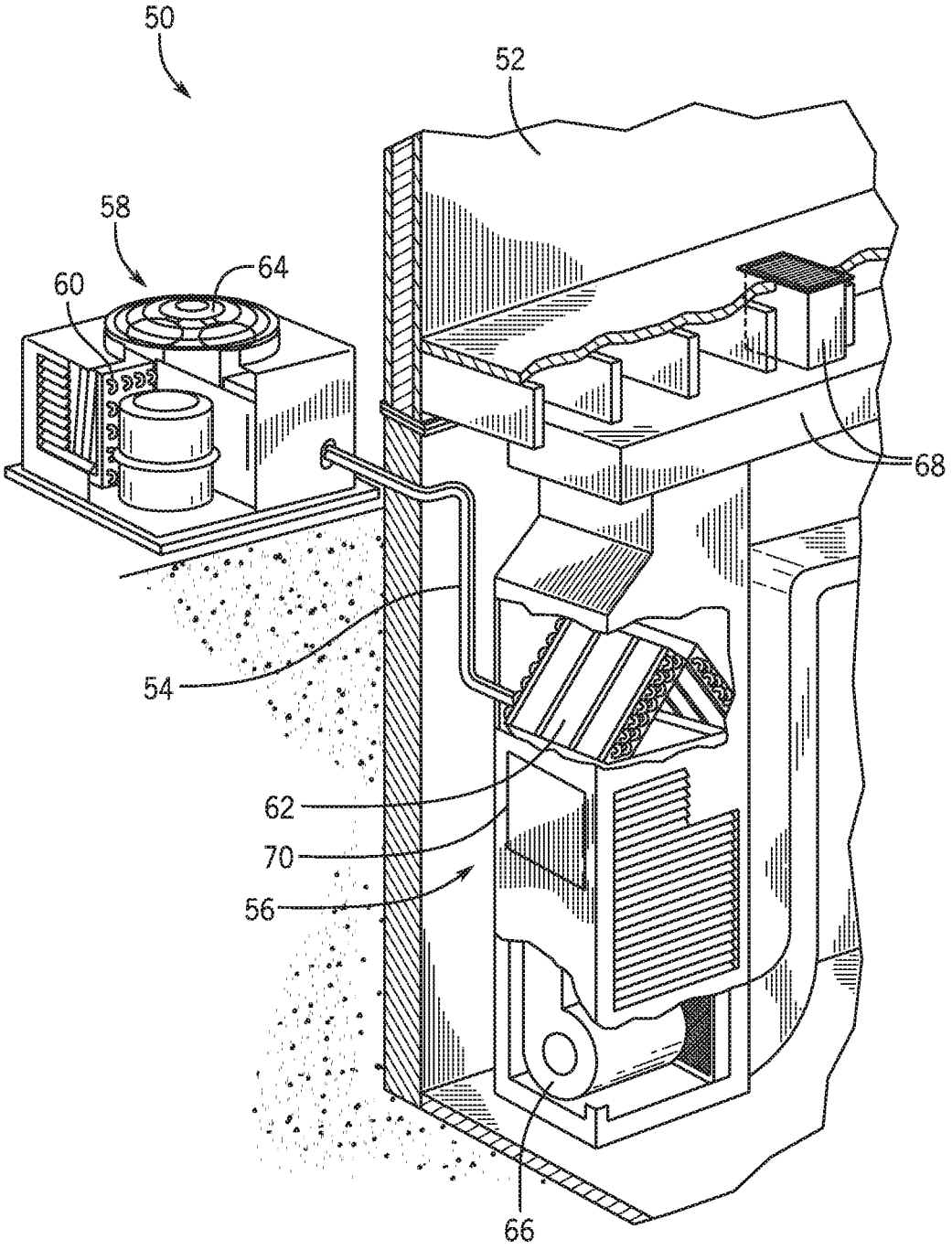
FIG. 3 is an illustration of an embodiment of a split system of the HVAC system, in accordance with present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger that is separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
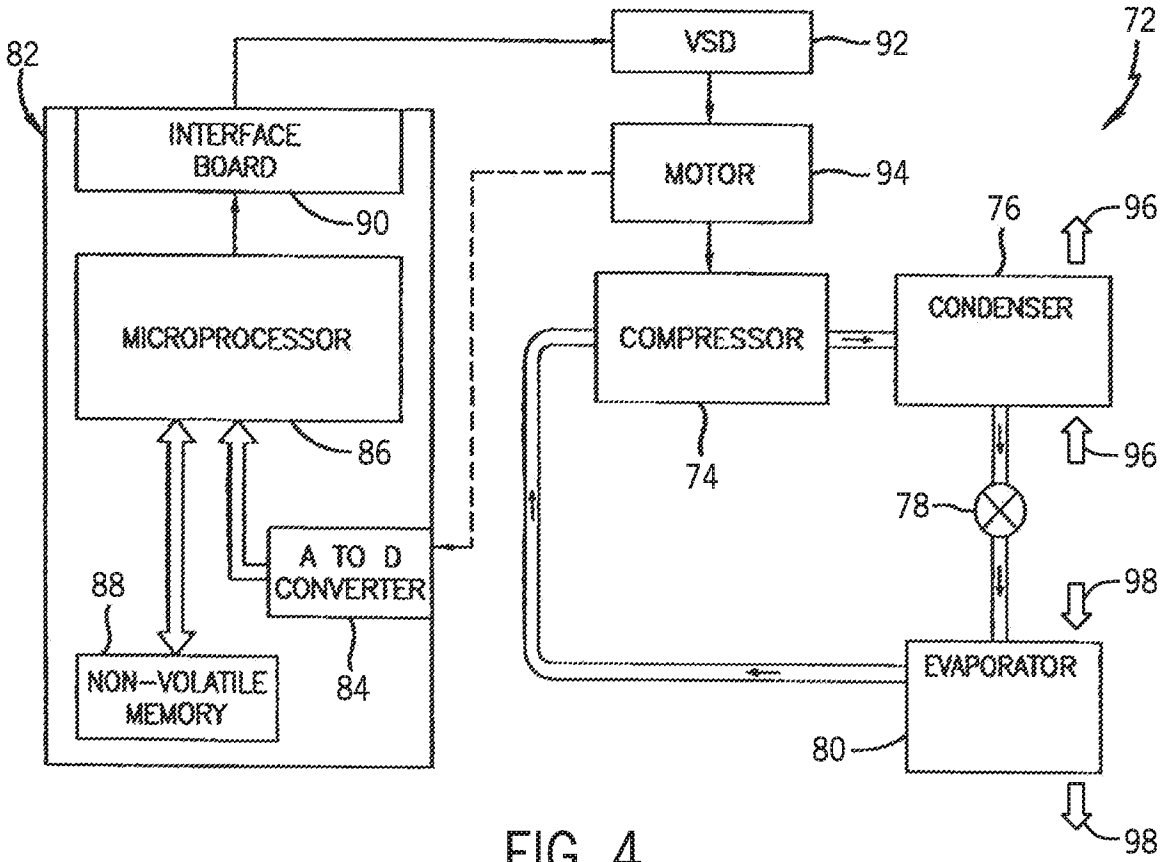
FIG. 4 is a schematic diagram of an embodiment of a refrigeration system of the HVAC system, in accordance with present techniques.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Moreover, in accordance with the present techniques, a coil heating system may be incorporated in any of the HVAC systems or heat pump systems illustrated in FIGS. 1-4. For example, the coil heating system can mitigate frost that may form on the heat exchanger 30 of the HVAC unit 12 of FIG. 2, the heat exchanger 60 of the residential heating and cooling system 50 of FIG. 3, or any other suitable heat exchanger that may develop frost under certain conditions. As discussed herein, the coil heating system provides thermal energy or heat to a heat exchanger to warm coils of the heat exchanger and a refrigerant flowing therein. The coil heating system thus reduces or eliminates a demand for reversing a refrigerant flow direction within the coil to defrost the heat exchanger. Moreover, the coil heating system may be operated to provide supplemental or auxiliary thermal energy to the heat exchanger during a heating mode, thereby enhancing an efficiency and/or speed at which the HVAC system may provide warm air to an interior space. The coil heating system will be described in detail below with reference to FIGS. 5-8.

Figure 5:
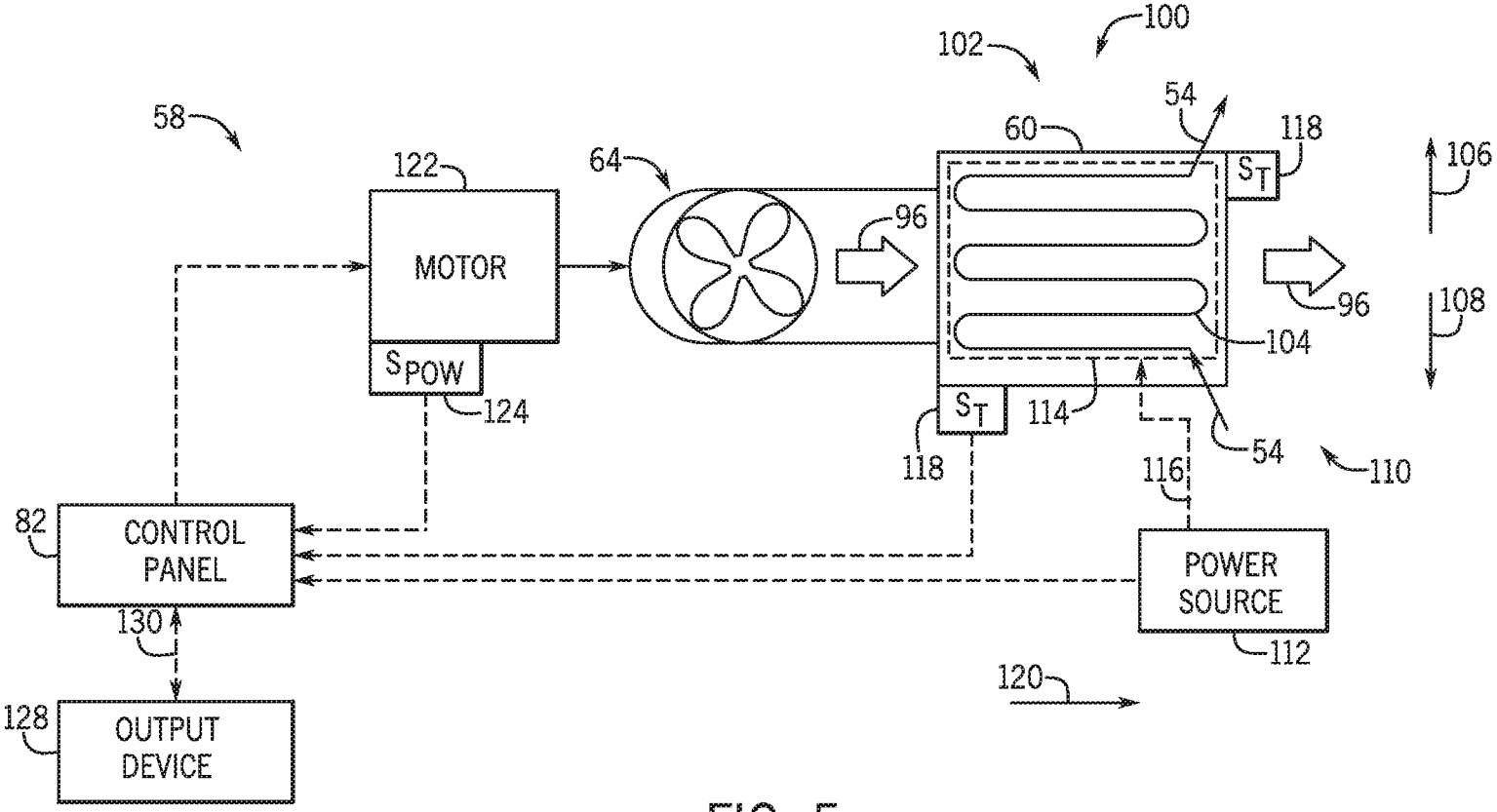
FIG. 5 is a schematic diagram of an embodiment of a coil heating system of the HVAC system, in accordance with present techniques.

FIG. 5 is a schematic diagram of a heat pump system 100 having a coil heating system 102 for the outdoor unit 58, in accordance with the present techniques. As described herein, the outdoor unit 58 may include the heat exchanger 60 and the fan 64. In the illustrated embodiment, the fan 64 blows the environmental air 96 across a coil 104 of the heat exchanger 60. In other embodiments, the fan 64 may instead pull the environmental air 96 across the coil 104 and toward the fan 64. Additionally, the refrigerant conduits 54 may route refrigerant to and from the heat exchanger 60 of the outdoor unit 58. As previously described, the heat exchanger 60 may operate as a condenser during an air conditioning or cooling mode of the heat pump system 100, and the heat exchanger 60 may operate as an evaporator during both a heating mode and a defrost mode of the heat pump system 100.

When operating as an evaporator, the refrigerant may flow through the heat exchanger 60 in a first flow direction 106, and when operating as a condenser, the refrigerant may flow through the heat exchanger 60 in a second flow direction 108, opposite of the first flow direction 106. Thus, based on operation of the coil heating system 102, a traditional defrosting process of using a reversing valve to reverse a refrigerant flow direction within the coil 104 for defrosting the coil 104 may be reduced or eliminated to increase an operating efficiency of the heat pump system 100 for conditioning the building 10. Thus, in certain embodiments, the reversing valve for reversing the refrigerant flow direction may only be used to switch the heat pump system 100 between the heating mode and the cooling mode, such as after a season change. However, in certain embodiments, the reversing valve may be employed in addition to the coil heating system 102 described herein to more rapidly mitigate frost on the coil 104.

As shown, the illustrated coil heating system 102 includes a resistive heating assembly 110 or resistive heater for heating the coil 104 and/or any other suitable components of the outdoor unit 58. In some embodiments, the coil heating system 102 may include a power source 112 and a resistive heating component 114 operatively coupled to the power source 112. For example, the power source 112 may include one or more batteries, one or more capacitors, one or more generators, one or more solar panels, one or more connections to a power supply of the building 10, and/or any other suitable power source for providing an electric current 116 to the resistive heating component 114. The resistive heating component 114 may be any suitable component that generates thermal energy in response to the electric current 116, such as via Joule heating. For example, the resistive heating component 114 may be a resistive coating applied to the coil 104 or a resistive heating element coupled to the coil 104. In some embodiments, the resistive heating component 114 may extend along a substantial portion or length of the coil 104, such as 20 percent, 50 percent, 80 percent, 100 percent, and so forth of a length of the coil 104 to provide thermal energy to the substantial portion of the coil 104.

Additionally, although illustrated as having one resistive heating component 114, it is to be understood that the resistive heating assembly 110 may include a plurality of resistive heating components 114, such as multiple layers of the resistive coating and/or multiple resistive heating elements coupled to the coil 104, as discussed in more detail below. For example, in such embodiments, one portion of the plurality of resistive heating components 114 may be resistive coatings, while another portion of the plurality of resistive heating components 114 may be resistive heating elements. Additionally, each resistive heating component 114 may be coupled to the power source 112 or coupled to individual power sources 112. Moreover, in addition or in alternative to having multiple resistive heating components 114, the coil heating system 102 may include multiple resistive heating assemblies 110.

Moreover, the coil heating system 102 includes the previously described control panel 82. Indeed, as discussed above, the control panel 82 may include any suitable components, such as a memory, a processor, a communication component, and so forth. The control panel 82 may provide control signals to regulate operation the heat pump system 100 and the coil heating system 102. To enhance operation of the coil heating system 102, the control panel 82 may receive sensor feedback indicative of various monitored or measured parameters of the heat pump system 100 from sensors included therein. For example, as illustrated, the control panel 82 is communicatively coupled to a temperature sensor 118, a fan motor 122, and a power sensor 124, such that the various monitored parameters may include a coil temperature, a power parameter, or both, as described below.

Thus, based on the various monitored parameters, the control panel 82 may determine whether a frost condition of the coil 104 is present. As used herein, a frost condition is defined as a condition in which frost or other frozen liquid has formed on the coil 104 of the heat exchanger 60 or may form on the coil 104 shortly, such as within a certain time threshold. For example, when the heat pump system 100 operates in the heating mode such that the heat exchanger 60 operates as the evaporator of the HVAC system, the coil 104 may condense water on the coil 104 if the outdoor temperature is near, at, or below freezing.

For example, the temperature sensor 118 may measure or monitor a temperature of the coil 104 of the heat exchanger 60 as a monitored parameter, and may communicate data or sensor signals indicative of the temperature to the control panel 82. The temperature sensor 118 may be disposed on or proximate to the heat exchanger 60 as illustrated. Additionally, in some embodiments, the temperature sensor 118 may be additionally or alternatively disposed downstream of the heat exchanger 60 relative to a flow direction 120 of the environmental air 96 to enable the control panel 82 to determine the temperature of the environmental air 96 after flowing over the heat exchanger 60. The control panel 82 may determine a detected coil temperature based on the data received from the temperature sensor 118, and compare the detected coil temperature with a predetermined threshold coil temperature. In some embodiments, the control panel 82 may determine that the coil 104 includes frost or may include frost soon if the detected coil temperature exceeds the predetermined threshold coil temperature. Moreover, in some embodiments, a plurality of temperature sensors 118 may be disposed on the heat exchanger 60 to monitor local temperatures of the heat exchanger 60. Thus, the control panel 82 may determine a temperature map indicative of the local temperatures of the heat exchanger 60.

Additionally, in some embodiments, the control panel 82 may control and monitor a power parameter of the fan 64 to determine whether the coil 104 has a frost condition. For example, the fan motor 122 may drive the fan 64 to draw the environmental air 96 across the heat exchanger 60 based on control signals from the control panel 82. Additionally, in some embodiments, the fan motor 122 includes a VSD or a static speed drive. Thus, when activated by the control panel 82, the fan motor 122 rotates the fan 64 to draw the environmental air 96 across the heat exchanger 60, which exchanges thermal energy with the refrigerant flowing within the coil 104 of the heat exchanger 60. The coil heating system 102 in the illustrated embodiment also includes a power sensor 124 configured to detect a power parameter of the fan 64. For example, the power parameter may be a voltage, current, resistance, torque, frequency, wattage, and so forth of the power provided to the fan motor 122 from any suitable power source or input. In the illustrated embodiment, the fan 64 is powered by a separate power source from the power source 112 of the resistive heating assembly 110, although in some embodiments, the fan 64 may be powered by the power source 112. In the illustrated embodiment, the power sensor 124 operates to measure or monitor the power parameter of the power provided to the fan motor 122. However, the power sensor 124 may, in another embodiment, monitor a power parameter related to the VSD, the static speed drive, the control panel 82, or any other suitable device for operating the fan 64 that receives power.

During certain frost conditions of the coil 104, as water or other liquid condenses and at least partially freezes as frost or ice on the coil 104, a pressure drop across the coil 104 may increase, and in some conditions, movement of the refrigerant through the refrigerant conduits 54 and the coil 104 may be affected. Thus, as the pressure drop across the coil 104 increases due to the frost on the coil 104, the fan motor 122 may increase its power input in order to maintain a target revolutions per minute (RPM) for operating the heat pump system 100. To facilitate determination of the frost condition, the power sensor 124 therefore detects a power parameter corresponding with the power input to the fan motor 122, and transmits data indicative of the power parameter to the control panel 82. The control panel 82 may determine a detected fan power based on the data received from the power sensor 124, and compare the detected fan power with a predetermined threshold fan power for the power parameter. In some embodiments, the control panel 82 may determine that the coil 104 has a frost condition if the detected fan power exceeds the predetermined threshold fan power.

Then, in response to determining that a frost condition is present, the coil heating system 102 may instruct the resistive heating assembly 110 to provide thermal energy to the coil 104 to mitigate frost formation and/or the frost condition. For example, if the control panel 82 determines that the temperature data is lower than a threshold temperature and/or that the power parameter is greater than a threshold power parameter, the control panel 82 may activate the resistive heating assembly 110. That is, by being communicatively coupled to power source 112, the control panel 82 can provide control signals to the power source 112 to instruct the power source 112 to provide the electric current 116 to selectively activate the resistive heating component 114. Thus, based on application of the electric current 116, the resistive heating assembly 110 may selectively heat the coil 104 and the refrigerant flowing within the coil 104 to block or mitigate frost formation thereon. Then, if the control panel 82 later determines that the detected coil temperature is higher than the predetermined threshold coil temperature and/or that the detected fan power is less than the predetermined threshold fan power, the control panel 82 may deactivate the resistive heating assembly 110.

Additionally, in certain embodiments, the coil heating system 102 may include an output device 128, such as an output interface on the heat pump system 100, a portable electronic device, a thermostat, and so forth. Then, in response to determining a frost condition, the control panel 82 may communicate a notification to the output device 128. In some embodiments in which the output device 128 is remote to the HVAC system, the control panel 82 may be communicatively coupled with a network 130, such as the Internet, which enables communication with the output device 128. Thus, users informed of the frost condition may perform any suitable manual defrosting actions to aid or facilitate defrosting of the coil 104 via the resistive heating assembly 110.

Figure 6:
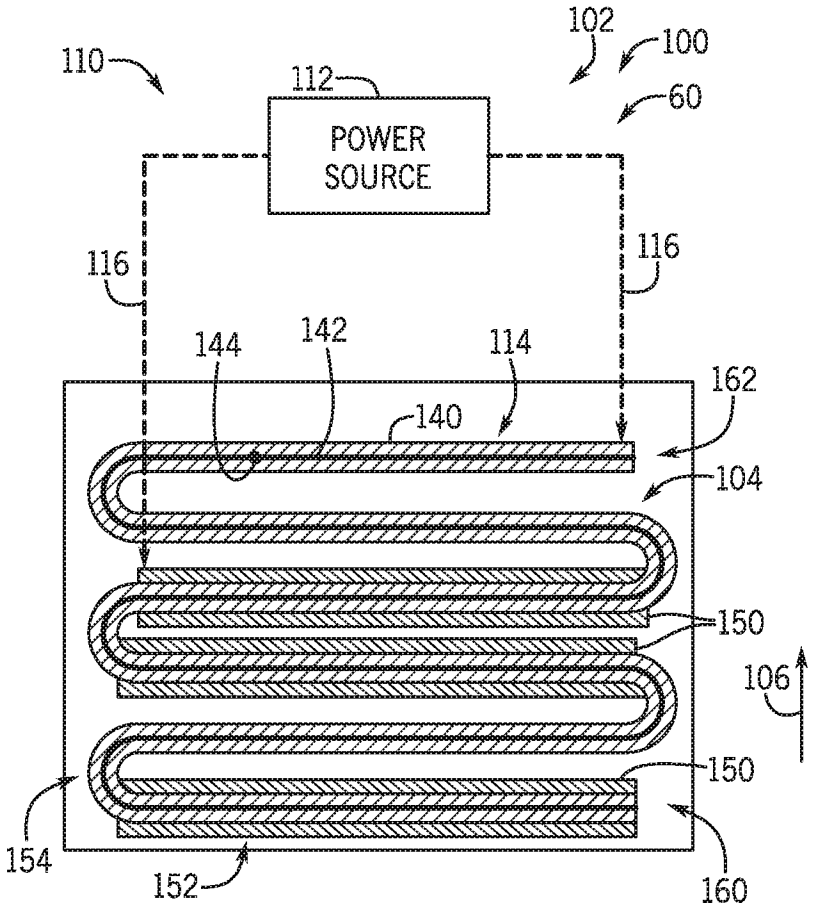
FIG. 6 is a schematic diagram of an embodiment of the coil heating system of the HVAC system of FIG. 5 having a resistive coating, in accordance with present techniques.

FIG. 6 is a schematic diagram of the heat exchanger 60 of the heat pump system 100 having the resistive heating assembly 110, in accordance with the present techniques. As illustrated, the resistive heating assembly 110 includes the power source 112 operatively coupled to one or more resistive heating components 114, which in the embodiment of FIG. 6, is a resistive coating layer 140. The resistive coating layer 140 is disposed directly on the coil 104, such that an outer surface 142 of the coil 104 is in contact with or covered by an inner surface 144 of the resistive coating layer 140. However, the resistive coating layer 140 may be applied to other suitable components of the heat exchanger 60, such as fins, distributors, manifolds, and so forth. In some embodiments, the resistive coating layer 140 is formed of any suitable electrically resistive material that converts the electric current 116 from the power source 112 into thermal energy. For example, the resistive coating layer 140 may include carbon or silicon coatings, electrical resistance paints, conductive paints, resistive paints, heating tape, and so forth. As such, the resistive coating layer 140 may be applied to the coil 104 via painting, powder coating, adhesives, fasteners, and so forth.

Additionally, as shown, the resistive heating assembly 110 may include multiple resistive coating layers 150 disposed over the resistive coating layer 140 at one or more selected portions of the coil 104 to enhance an amount of thermal energy generated in the selected portions. For example, the multiple resistive coating layers 150 may be disposed at straight portions 152 of the coil 104 and/or bent portions 154 of the coil 104 to provide additional thermal energy to the portions of the coil 104. In some embodiments, the multiple resistive coating layers 150 are separated as shown, although in other embodiments, the multiple resistive coating layers 150 extend along a same length of the coil 104 that the resistive coating layer 140 extends. Additionally, the power source 112 may individually activate the individual layers or portions of the resistive coating layers 140 and/or multiple resistive coating layers 150 based on a desired heating load of the coil 104. For example, in embodiments having multiple temperature sensors 118, the control panel 82 may selectively activate more resistive coating layers 140 near colder portions of the coil 104, as compared to warmer portions of the coil 104.

Moreover, as recognized herein, providing thermal energy to an upstream or proximal portion 160 of the coil 104 relative to the first flow direction 106 during the heating mode may be more effective at mitigating frost formation on a greater portion of the coil 104, as compared to thermal energy provided to a downstream or distal portion 162 of the coil 104. For example, the additional thermal energy provided to the proximal portion 160 via the multiple resistive coating layers 150 may be absorbed by the refrigerant within the coil 104, which transfers the thermal energy to downstream portions of the coil 104 during its flow within the coil 104. As such, based on application of the electric current 116 through the power source 112, the resistive coating layer 140 and/or the multiple resistive coating layers 150 can provide thermal energy to the coil 104 and to refrigerant within the coil 104 to reduce a demand for reversing refrigerant flow within the heat pump system 100 to defrost the coil 104.

Figure 7:
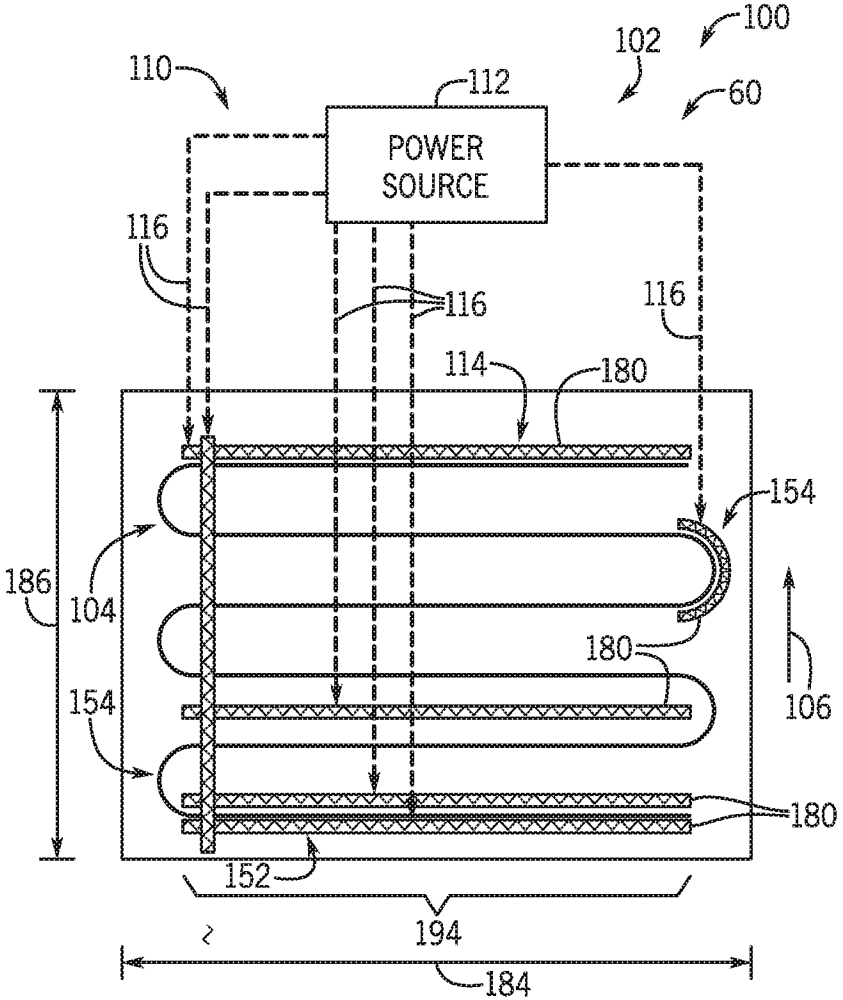
FIG. 7 is a schematic diagram of an embodiment of the coil heating system of the HVAC system of FIG. 5 having resistive heating elements, in accordance with present techniques.

FIG. 7 is a schematic diagram of the heat exchanger 60 of the heat pump system 100 having the resistive heating assembly 110, in accordance with the present techniques. As illustrated, the resistive heating assembly 110 of FIG. 7 includes the power source 112 operatively coupled to multiple resistive heating components 114, which in the embodiment of FIG. 7, are resistive elements 180. The resistive elements 180 may each be any suitable wire or component that resists the electric current 116 supplied by the power source 112, and generates thermal energy from the resistance. For example, the resistive elements 180 may be or include nichrome, resistance wire, etched foil, resistance mesh, and so forth.

The resistive elements 180 are disposed on the coil 104 in any suitable configuration for providing thermal energy to the coil 104. For example, the resistive elements 180 may be coupled to the straight portions 152 and/or the bent portions 154 of the coil 104. Additionally, the resistive elements 180 may extend directly along the coil 104 and/or between adjacent straight portions 152 of the coil 104. The resistive elements 180 may also extend generally parallel to a length 184 of the coil 104 and/or generally parallel to a height 186 of the coil 104. Further, as shown, multiple resistive elements 180 may be disposed along a shared or common length 194 of the coil 104 to increase the thermal energy provided to the coil 104. Additionally, in some embodiments, one resistive element 180 may extend along an entire or main length of the coil 104 to apply thermal energy directly to the main length of the coil 104. Thus, based on application of the electric current 116 through the power source 112, the resistive elements 180 can provide thermal energy to the coil 104 and to refrigerant within the coil 104 to reduce a demand for reversing refrigerant flow within the heat pump system 100 to defrost the coil 104.

Figure 8:
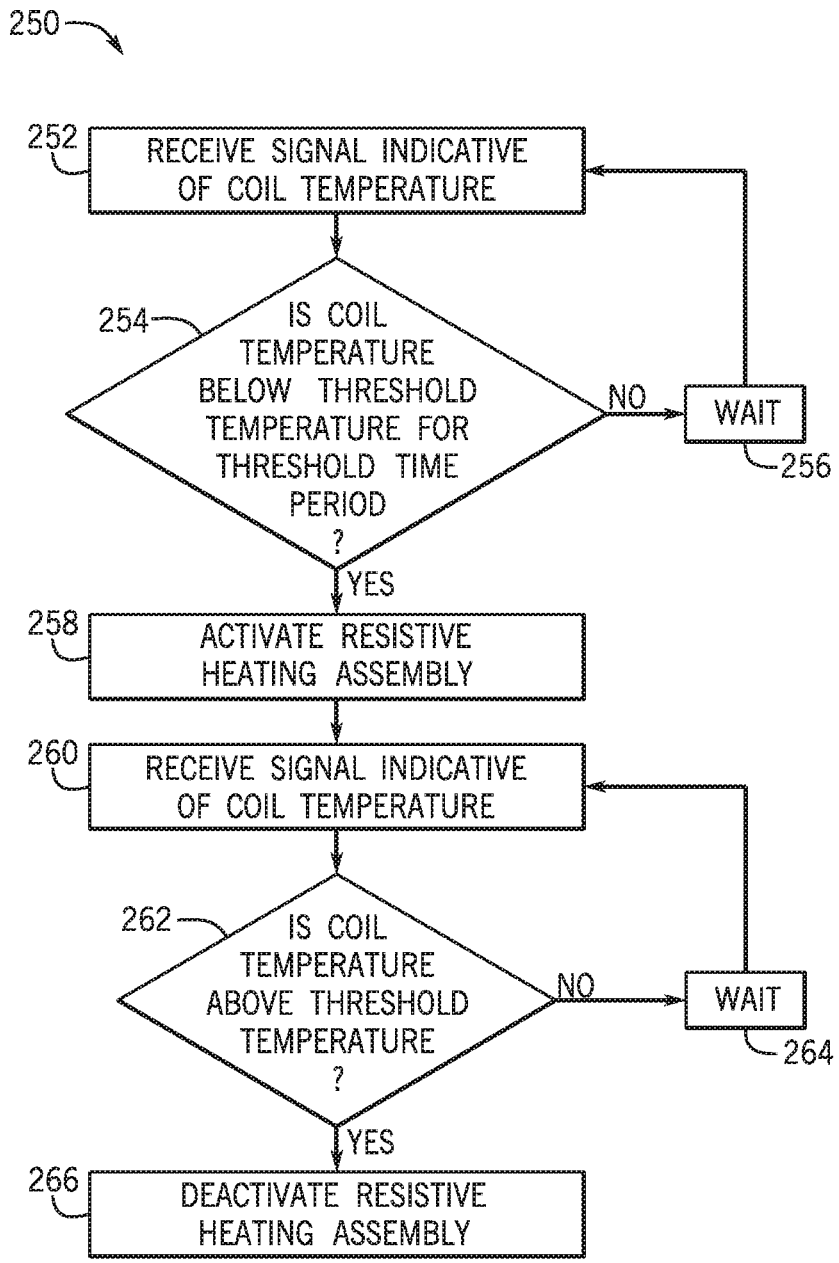
FIG. 8 is a flow chart of an embodiment of a method for operating the coil heating system to mitigate frost formation, in accordance with the present techniques.

FIG. 8 is a flow chart of an embodiment of a method 250 for operating the coil heating system 102 to mitigate frost formation on the heat exchanger 60. The method 250 of FIG. 8 is described with reference to the elements of FIGS. 1-7. One or more steps of the method 250 may be performed simultaneously or in a different sequence than the sequence in FIG. 8. The method 250 may be performed by the control panel 82 of the heat pump system 100 or by another suitable controller communicatively coupled to the coil heating system 102 of the heat pump system 100. First, as indicated by block 252, the method 250 includes the control panel 82 receiving a signal indicative of a coil temperature. For example, the control panel 82 may receive signals from the one or more temperature sensors 118 near the heat exchanger 60. The temperature sensors 118 may transmit signals to the control panel 82 upon request by the control panel 82, continuously, at regular intervals, every minute, every ten minutes, or the like. Then, based on the signals, the control panel 82 may determine the coil temperature of the coil 104 over time.

As indicated by block 254, the control panel 82 may determine whether the coil temperature is below a threshold temperature for a threshold time period. In other embodiment, the control panel 82 may determine that a coil temperature is detected below the threshold temperature for multiple successive detections. In other words, instead of detecting a coil temperature below a threshold temperature for a threshold time period, the control panel 82 may determine that the measured coil temperature is below a threshold temperature for a threshold number of successive detections or measurements. The threshold temperature may be a user-set, technician-set, or distributor-set value that is stored within the control panel 82 either before or after the control panel 82 is placed into operation within the heat pump system 100. In some embodiments, the threshold temperature for various coil heating systems 102 may be individually adjusted for each heat pump system 100 to account for expected weather, location, and/or elevation of the heat pump system 100. Additionally, the threshold temperature may be manually or automatically adjusted based on expected weather conditions. For example, the control panel 82 may raise the threshold temperature to a higher temperature or level in response to determining that cooler weather is upcoming, thus providing a larger buffer range between the coil temperature and the freezing point of water. The threshold temperature may be set as any suitable temperature at or above the freezing point of water, such as 0 degrees Celsius, 1 degree Celsius, 3 degrees Celsius, and so forth. By setting the threshold temperature to a temperature above a freezing point of water, the coil heating system 102 may mitigate frost formation on the coil 104 while increasing or maximizing user comfort within the building 10. Alternatively, by setting the threshold temperature to a temperature at the freezing point of water, the coil heating system 102 may operate the resistive heating assembly 110 less often to increase a power savings of the heat pump system 100, while also mitigating frost formation on the coil 104.

In response to determining that the coil temperature is not below the threshold temperature for the threshold time period or for a threshold number of successive temperature measurements, the control panel 82 may proceed to wait a predefined amount of time, as indicated by block 256. Then, the control panel 82 may continue to receive signals indicative of the coil temperature, as indicated in block 252. Thus, the heat pump system 100 may continue to operate in the heating mode without activating the resistive heating assembly 110. As discussed above, in the heating mode, the heat exchanger 60 operates as an evaporator to provide warm air to the interior space of the building 10.

Alternatively, in response to determining that the coil temperature is below the threshold temperature for the threshold time period or that the coil temperature is below the threshold temperature for a threshold number of successive temperature measurements, the control panel 82 may proceed to activate the resistive heating assembly 110, as indicated by block 258. For example, the control panel 82 may activate the resistive heating assembly 110 by instructing the power source 112 to provide an electric current to the one or more resistive heating components 114. Thus, the heat pump system 100 can continue to provide thermal energy to the interior space of the building while also mitigating frost formation on the coil 104 during a defrost mode, eliminating or reducing a demand for reversing the refrigerant flow direction to defrost the coil 104. Moreover, by activating the resistive heating assembly 110 upon determination that the coil temperature is below the threshold temperature for the threshold time period, the heat pump system 100 reduces cycling of the resistive heating assembly 110 by verifying a steadiness of the coil temperature below the threshold temperature before activating the resistive heating assembly 110.

As indicated by block 260, the control panel 82 may receive another signal, such as a subsequent signal, indicative of the coil temperature. Thus, the control panel 82 may determine the coil temperature after the resistive heating assembly 110 has been activated for a predetermined amount of time, and monitor performance of the resistive heating assembly 110 based on the coil temperature. By monitoring performance of the resistive heating assembly 110, the coil heating system 102 can actively adjust operation of the resistive heating assembly 110 based on sensor feedback, such as in a closed loop control process.

Next, as indicated by block 262, the control panel 82 may determine whether the coil temperature is above a threshold temperature. In some embodiments, the threshold temperature of block 262 is a higher threshold temperature that is greater than a lower threshold temperature of block 254. For example, by setting the threshold temperature of block 262 to be higher than the lower threshold temperature of block 254, the control panel 82 is capable of raising the coil temperature to a buffered coil temperature, thus enabling the coil 104 to operate longer in a colder environment between operations of the resistive heating assembly 110. However, in some embodiments, the threshold temperature of block 262 is the same threshold temperature of block 254 to enable the control panel 82 to maintain the coil 104 at a constant or nearly constant coil temperature.

In response to determining that the coil temperature is not above the threshold temperature, the control panel 82 may proceed to wait, as indicated by block 264. Thus, the resistive heating assembly 110 continues to operate to provide thermal energy to the coil 104. As such, the control panel 82 may continue to receive signals indicative of the coil temperature, as indicated in block 260. In certain embodiments, the control panel 82 may additionally monitor a rate of change of the coil temperature. Then, in response to determining that a rate of change of the coil temperature is not above a rate of change temperature threshold, the control panel 82 may determine that the coil temperature is not satisfactorily improving or increasing. Thus, in embodiments in which the coil heating assembly includes multiple resistive heating assemblies 110, the coil heating system 102 may activate additional resistive heating assemblies in response to this determination to further increase a rate at which the thermal energy is provided to the coil 104.

In response to determining that the coil temperature is above the threshold temperature, the control panel 82 may deactivate the resistive heating assembly 110, as indicated by block 266. Thus, the coil heating system 102 may modulate operation of the resistive heating assembly to selectively apply heat to the coil. By pulsing the application of thermal energy transferred to the coil 104 in this manner, the coil heating system 102 may increase an efficiency of the heat pump system 100 by reducing a demand for reversing a direction of the refrigerant flow for defrosting the heat exchanger 60. Thus, in embodiments in which the heat pump system 100 is capable of operating in a cooling mode, the refrigerant may be reversed only when switching from the heating mode and/or the defrost mode to the cooling mode.

Although described with reference to operating one resistive heating assembly 110, it is to be understood that the control panel 82 may coordinate operation of multiple resistive heating assemblies 110 in embodiments in which multiple resistive heating assemblies 110 are present. Additionally, although described with reference to monitoring the temperature of the coil 104, other suitable parameters indicative of frost formation may additionally or alternatively be monitored by the control panel 82, such as the fan power discussed above, a coefficient of performance of the heat pump system, a pressure drop across the heat pump system, and so forth. Moreover, although the method 250 is described with reference to operating the coil heating system 102 during the defrost mode of the heat pump system 100, it is to be understood that similar steps may be followed to operate the coil heating system 102 in the heating mode, thus providing additional heat to the refrigerant within the coil 104 and thus to the interior space of the building 10 upon request for additional heating. In such embodiments, the coil heating system 102 operating in the heating mode may include higher thresholds for the coil temperatures or other suitable parameters indicative of frost formation to enable the refrigerant within the coil 104 to be heated to a higher temperature, thus absorbing a suitable amount of thermal energy for heating air to be provided to the interior space of the building 10.

Accordingly, the present disclosure is directed to a coil heating system for directly transferring thermal energy to a coil of a heat pump system via a resistive heater. The resistive heater may include any suitable resistive coating and/or resistive element in thermal contact with the coil and operatively coupled to a power source. By activating the resistive heater, the coil heating system is configured to maintain a temperature of the coil above freezing, thus mitigating any frost formation on the coil and reducing a demand for reversing a direction of the refrigerant flow to defrost the coil. Moreover, because the resistive heater can apply heat directly to the coil, the refrigerant within the coil may absorb thermal energy and provide thermal energy to an interior space of a building. As such, the coil heating system may also operate during a heating mode of the heat pump system to enhance user comfort by more quickly heating the interior space.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat pump system, comprising:

an outdoor heat exchanger coil configured to operate as an evaporator in both a heating mode and an outdoor unit defrost mode of the heat pump system;

a heater configured to transfer heat to the outdoor heat exchanger coil; and a controller communicatively coupled to the heater, wherein the controller is configured to activate the heater in response to determining that a detected temperature of the outdoor heat exchanger coil is below a threshold temperature for a threshold number of successive detections.

2. The heat pump system of claim 1, wherein the heater is a resistive heater in contact with an outer surface of the outdoor heat exchanger coil, and wherein an inner surface of the outdoor heat exchanger coil disposed opposite the outer surface is configured to contact a refrigerant.

3. The heat pump system of claim 2, wherein the resistive heater comprises a coating disposed on the outdoor heat exchanger coil to increase resistivity of the heater.

4. The heat pump system of claim 1, wherein the heater further comprises a resistive heating element coupled to the outdoor heat exchanger coil.

5. The heat pump system of claim 1, wherein the controller is configured to activate the heater in the heating mode of the heat pump system in response to a request for supplemental heating of a conditioned interior space.

6. The heat pump system of claim 1, wherein the heat pump system is configured to provide heated air to a conditioned interior space of a building in the heating mode of the heat pump system, and wherein the heat pump system is configured to provide the heated air to the conditioned interior space of the building and mitigate frost formation on the outdoor heat exchanger coil in the outdoor unit defrost mode of the heat pump system.

7. The heat pump system of claim 1, wherein the controller is configured to continue to activate the heater in response to determining that a subsequent detected temperature of the outdoor heat exchanger coil is below the threshold temperature.

8. The heat pump system of claim 1, wherein the controller is configured to deactivate the heater in response to determining that the detected temperature of the outdoor heat exchanger coil is above the threshold temperature.

9. The heat pump system of claim 1, wherein the threshold temperature is a first threshold temperature, wherein the controller is configured to deactivate the heater in response to determining that the detected temperature of the outdoor heat exchanger coil is above a second threshold temperature, and wherein the second threshold temperature is greater than the first threshold temperature.

10. The heat pump system of claim 1, wherein the threshold temperature comprises a temperature above a freezing point of water.

11. The heat pump system of claim 1, comprising a sensor disposed proximate the outdoor heat exchanger coil and configured to measure the detected temperature of the outdoor heat exchanger coil.

12. The heat pump system of claim 1, comprising a fan configured to draw environmental air across the outdoor heat exchanger coil, wherein the threshold number of successive detections comprises a first threshold number of successful detections, and wherein the controller is configured to activate the heater in the outdoor unit defrost mode of the heat pump system in response to determining that a detected power parameter of the fan is above a threshold power parameter for a second threshold number of successful detections.

13. The heat pump system of claim 12, comprising a sensor disposed proximate the fan and configured to measure the detected power parameter of the fan.

14. The heat pump system of claim 1, wherein the heater is a first heater, wherein the heat pump system comprises a second heater, and wherein the controller is configured to activate the second heater in response to determining that the detected temperature of the outdoor heat exchanger coil is not increasing in response to activation of the first heater.

15. The heat pump system of claim 1, wherein the outdoor heat exchanger coil is configured to circulate a refrigerant in a first direction in both the heating mode and the outdoor unit defrost mode of the heat pump system, and wherein the outdoor heat exchanger coil is configured to circulate the refrigerant in a second direction in a cooling mode of the heat pump system.

16. A heat pump system, comprising:

an outdoor heat exchanger comprising a coil configured to circulate a refrigerant in a common direction in both a heating mode and an outdoor unit defrost mode of the heat pump system;

a heater configured to transfer heat to the coil when activated and comprising a resistive coating disposed on the coil; and a controller communicatively coupled to the heater and configured to activate the heater in the outdoor unit defrost mode in response to determining that a detected temperature of the coil is below a threshold temperature for a threshold number of successive detections.

17. The heat pump system of claim 16, wherein the resistive coating comprises a carbon coating, a silicon coating, an electrical resistance paint, a conductive paint, a heating tape, or any combination thereof.

18. The heat pump system of claim 16, wherein the coil comprises an upstream portion of the coil relative to the common direction, and wherein the resistive coating is disposed on the upstream portion.

19. The heat pump system of claim 16, wherein the resistive coating is disposed on the coil in a plurality of layers.

20. The heat pump system of claim 16, wherein the controller is configured to activate the heater by adjusting an electric current provided to the resistive coating.

21. The heat pump system of claim 16, wherein the controller is configured to activate the heater in the outdoor unit defrost mode in response to determining that the detected temperature of the coil is below the threshold temperature for a threshold time period.

22. The heat pump system of claim 16, wherein the controller is configured to deactivate the heater in response to determining that the detected temperature of the coil is above the threshold temperature.

23. A heat pump system, comprising:

an outdoor heat exchanger coil;

a resistive heater configured to transfer heat to the outdoor heat exchanger coil when activated and comprising a resistive coating disposed on the outdoor heat exchanger coil; and a controller communicatively coupled to the resistive heater and configured to:

activate the resistive heater in an outdoor unit defrost mode in response to determining that a parameter of the heat pump system is outside of a threshold parameter range for a threshold time period; and activate the resistive heater in a heating mode of the heat pump system in response to a request for supplemental heating of a conditioned interior space.

24. The heat pump system of claim 23, wherein the controller is configured to deactivate the resistive heater in response to determining that the parameter is within the threshold parameter range.

25. The heat pump system of claim 23, wherein the parameter comprises a detected temperature of the outdoor heat exchanger coil, wherein the threshold parameter range comprises a lower threshold temperature, and wherein the parameter is outside of the threshold parameter range when the detected temperature is below the lower threshold temperature.

26. The heat pump system of claim 23, wherein the parameter comprises a power supplied to a fan configured to draw air over the outdoor heat exchanger coil, wherein the threshold parameter range comprises an upper threshold power, and wherein the parameter is outside of the threshold parameter range when the power supplied to the fan is above the upper threshold power.

* * * * *